US010407279B2

(12) United States Patent
Kalynytschenko

(10) Patent No.: US 10,407,279 B2
(45) Date of Patent: Sep. 10, 2019

(54) ELEVATOR GUIDE RAIL ATTACHMENT CLIP

(71) Applicant: Inventio AG, Hergiswil (CH)

(72) Inventor: Eduardo Kalynytschenko, Santo André (BR)

(73) Assignee: INVENTIO AG, Hergiswil NW (CH)

( * ) Notice: Subject to any disclaimer, the term of this patent is extended or adjusted under 35 U.S.C. 154(b) by 0 days.

(21) Appl. No.: 16/065,168

(22) PCT Filed: Dec. 13, 2016

(86) PCT No.: PCT/EP2016/080736
§ 371 (c)(1),
(2) Date: Jun. 22, 2018

(87) PCT Pub. No.: WO2017/108495
PCT Pub. Date: Jun. 29, 2017

(65) Prior Publication Data

US 2019/0023533 A1 Jan. 24, 2019

(30) Foreign Application Priority Data

Dec. 22, 2015 (EP) ..... 15202145

(51) Int. Cl.
*B66B 7/02* (2006.01)

(52) U.S. Cl.
CPC ..... *B66B 7/024* (2013.01); *B66B 7/02* (2013.01)

(58) Field of Classification Search
CPC ..... B66B 7/024; B66B 7/02; B66B 19/002; E01B 13/02; E01B 2201/08
See application file for complete search history.

(56) References Cited

U.S. PATENT DOCUMENTS 1,925,867 A * 9/1933 Dunlop ..... B66B 7/02 187/408
2,009,309 A * 7/1935 Davies ..... E01B 9/683 238/283
2,479,932 A * 8/1949 Hunnicutt ..... E01B 13/02 238/315

(Continued)

FOREIGN PATENT DOCUMENTS

EP 0585684 A1 3/1994
JP 2003040552 A 2/2003

*Primary Examiner* — Michael A Riegelman

(74) *Attorney, Agent, or Firm* — William J. Clemens; Shumaker, Loop & Kendrick, LLP

(57) ABSTRACT

A clip for attaching an elevator guide rail to a support bracket includes: an attachment part for attaching the clip to the support bracket; a clamping part for clamping the guide rail against the support bracket; a pin guided in the clamping part and movable between a pushed-in position and a protruding position, in which the pin protrudes from the clamping part; a spring element arranged inside the clamping part and biased against the movement from the protruding position into the pushed-in position; wherein the clamping part includes a clip friction surface for touching the guide rail, when the pin is in the pushed-in position, and the pin includes a pin friction surface for touching the guide rail, when the pin is in the protruding position, which pin friction surface has a lower friction coefficient than the clip friction surface.

17 Claims, 2 Drawing Sheets

(56) References Cited

U.S. PATENT DOCUMENTS

| | | | | | |
|---|---|---|---|---|---|
| 2,638,276 | A * | 5/1953 | Stamm | E01B 9/486 | 238/349 |
| 3,982,692 | A * | 9/1976 | Feyrer | B66B 7/02 | 187/408 |
| 4,324,360 | A * | 4/1982 | Sun | B66B 7/024 | 187/408 |
| 4,593,786 | A * | 6/1986 | Tate | B60K 5/10 | 180/291 |
| 5,203,501 | A * | 4/1993 | Vanotti | E01B 9/483 | 238/265 |
| 5,292,096 | A * | 3/1994 | Bodenheimer | F16M 5/00 | 248/228.5 |
| 5,582,371 | A * | 12/1996 | Humphrey | E01B 7/02 | 238/338 |
| 2004/0216963 | A1* | 11/2004 | Kurzo | B66B 7/02 | 187/408 |
| 2016/0311654 | A1* | 10/2016 | Ekstrom | B66B 7/024 | |
| 2018/0354750 | A1* | 12/2018 | Fonteneau | B66B 7/02 | |
| 2018/0362299 | A1* | 12/2018 | Polinski | B66B 7/024 | |
| 2018/0370766 | A1* | 12/2018 | Madureira De Almeida | B66B 7/024 | |
| 2019/0023533 | A1* | 1/2019 | Kalynytschenko | B66B 7/02 | |

* cited by examiner

ELEVATOR GUIDE RAIL ATTACHMENT CLIP

FIELD

The present invention relates to a clip for attaching an elevator guide rail to a support bracket and to an elevator guiding system comprising such a clip.

BACKGROUND

Usually, the one or more vertical guide rails of an elevator, which are used for guiding the elevator car inside an elevator shaft in a vertical direction, are supported by brackets, each of which is attached to a wall of the elevator shaft. However, the brackets may change their distance with respect to each other due to so called building contraction.

Building contraction is one event that affects most of civil constructions. It is caused by the settlement of the building and soil, mortar dehydration, etc., starting at the beginning of construction and continuing during some months until the building stabilizes. However, even after years a building may be affected by such contraction events (although comparable small with respect to the one at the beginning of the construction). The taller the building is, the bigger is the total length of contraction, reaching tens of centimeters in some cases, which also may affect the elevator and in particular its guide rail support structure.

In order to minimize these effects, clips used to fix the guide rail to the brackets may allow sliding between the guide rail and prevent the bracket and the guide rail from high stress or even structural failure such as buckling, irreversible deformation or the like. However, sliding clips with a low friction value may have a negative effect on the overall rigidity and ability of the guide rail support structure to support a high load. In contrast, fixed clips providing a high friction between the guide rail and the bracket, a high stiffness and a high ability of supporting loads may not be designed for compensating building contraction.

U.S. Pat. No. 1,925,867 shows an elevator guide rail supporting device with a spring clamp pressed against a bearing member for supporting the guide rail.

SUMMARY

An objective of this invention is to provide a simple and economic elevator guiding system and support structure for supporting guide rails of an elevator that may compensate building contraction and at the same time may support high loads.

An aspect of the invention relates to a clip for attaching an elevator guide rail to a support bracket. The support bracket may be mounted to a wall of an elevator shaft, for example via bolts. The elevator guide rail may be an elongated member, which may have a T-shaped cross-section. A flat surface of a foot of the guide rail may be positioned on the support bracket. The clip may be attached to the bracket (for example via a bolt or screw) and may clamp the guide rail against the bracket. More than one clip may be used for clamping respectively attaching the guide rail to one bracket. For example, two clips at opposite sides of a foot of the guide rail.

According to an aspect of the present invention, the clip comprises an attachment part for attaching the clip to the support bracket; a clamping part for clamping the guide rail against the support bracket; a pin guided in the clamping part and movable between a pushed-in position and a protruding position, in which the pin protrudes from the clamping part; and a spring element arranged inside the clamping part and biased against the movement from the protruding position into the pushed-in position. The clamping part comprises a clip friction surface for touching the guide rail, when the pin is in the pushed-in position, and the pin comprises a pin friction surface for touching the guide rail, when the pin is in the protruding position, which pin friction surface has a lower friction as the clip friction surface.

The attachment part and the clamping part may be a one piece element, wherein the spring element and the pin may be provided as further elements of the clip.

The clip may be attached with the attachment part to the bracket (for example via a screw or a bolt) and may clamp the guide rail against the bracket.

The clamping force may be set in such a way and/or the resilient force of the spring element may be chosen in such a way that in a normal loaded situation, the spring element pushes the pin out of the clamping part and only the pin friction surface is in contact with the guide rail. In such a way, the guide rail may move with respect to the clip and the bracket, when building contraction takes place, since the friction forces of the pin friction surface may be chosen to allow a movement of the guide rail in relation to the clip respectively to the bracket. In the normal loaded situation, the clip may be seen as a sliding clip.

In the normal loaded situation, the elevator car may be remote from the corresponding attachment region of the guide rail. The attachment region of the guide rail may comprise a bracket, a clip and a part of the guide rail, which is clamped with the clip to the bracket. If the elevator car approaches an attachment region, the elevator car applies an additional (lateral) force to the respective part of the guide rail, which force is transferred by the guide rail to the respective pin and clip. The resilient force is chosen in such a way that in this car loaded situation, the pin is pushed into the clip and the guide rail comes into contact with the clip friction surface (provided on the clip on the same side as the pin friction surface). In the car loaded situation, the clip may act as a stiff clip.

In such a way, the advantages of a sliding clip and s stiff clip are combined in one clip. Although the clip may be adapted to withstand high forces in the presence of the elevator car, the impact created by building contraction on the guide rails may be minimized. Furthermore, the clip may allow for the design of lighter brackets due the low values of friction in the normal loaded situation.

It may be that in the pushed-in position, the pin friction surface as well as the clip friction surface are touching the rail. In the protruding position, the pin friction surface may protrude over the clip friction surface and/or only the pin friction surface may touch the rail.

According to an aspect of the present invention, the pin friction surface is convex. It may be possible that the friction coefficient of the pin friction surface may be set by the total area in contact with the guide rail. This area (and therefore the friction) may be minimized by using a convex surface. For example, a spherical surface may be used as pin friction surface.

A further way of influencing the friction coefficient of the pin friction surface is the material of the pin, which may be made of plastics.

According to an aspect of the present invention, the clip friction surface is flat. With a flat surface, a comparable high friction coefficient may be reached. A further way of influencing the friction coefficient of the clip friction surface is the material of the clip, which may be made of metal and/or steel.

According to an aspect of the present invention, the clip friction surface surrounds the pin friction surface. For example, the clip friction surface may be provided by the material of the clamping part, which houses the pin.

According to an aspect of the present invention, the clamping part comprises a pin hole for receiving and/or guiding the pin. The pin hole may be a blind hole, which may have a slight bigger diameter as the pin or at least a head of the pin.

According to an aspect of the present invention, an axial distance between a backside of a head of the pin to a bottom of the pin hole is bigger than a distance the pin friction surface is protruding from the clamping part. The space in the pin hole between a bottom of the pin hole and the backside of the head may accommodate the spring element. The distance of the bottom of the pin hole to the backside of the pin may be chosen that even in the pushed-in position, the spring element is only contracted without being damaged.

According to an aspect of the present invention, the pin comprises a foot protruding through a hole in the clamping part. The foot hole may be provided in the bottom of the pin hole and/or may have a smaller diameter as the pin hole. The foot in the foot hole may be used for guiding the pin in its axial direction.

Furthermore, the foot of the pin may comprise a sideward protrusion for preventing the pin to move out of the clamping part, when moved in the protruding position. The spring element may push the pin automatically out of the pin hole, when the pin is not loaded enough. The sideward protrusion or barb hook will finish this movement at a specific position. During assembly of the clip, the pin may be pushed with its foot in the foot hole and the sideward protrusion may act as a snap click connection.

According to an aspect of the present invention, the pin comprises a head, which provides the pin friction surface, wherein the head is attached to the foot and wherein the head has a bigger diameter than the foot. In general, the pin may comprise a mushroom shape. The head and/or the foot may have a circular cross-section.

According to an aspect of the present invention, the pin comprises a slot for receiving the spring element. For example, the slot may be provided in a backside of the head of the pin and/or may surround the foot of the pin. However, it also may be possible that the slot is provided in the bottom of the pin hole.

According to an aspect of the present invention, the spring element is a resilient ring accommodated between a head of the pin and the clamping part. The ring may be made of rubber or other resilient material. It also may be possible that the spring element is a ring-shaped disc spring or plate spring.

According to an aspect of the present invention, the ring is accommodated in a slot (in the pin and/or in the clamping part) wider than the ring, such that the ring is deformable in the slot in a lateral direction, when the pin is pressed against the clamping part. Usually, when compressed the ring, which may have a substantially circular cross-section and/or which may be deformed to a substantially ellipsoid cross-section. The slot may have a cross-section with a diameter that is adapted for accommodating the rubber-ring in the compressed state.

According to an aspect of the present invention, the attachment part and/or the clamping part are made of steel. The attachment part and the clamping part may be a one piece steel part, in which the spring element and the pin are inserted. The clip friction surface (as provided by the clamping part) also may be made of steel.

According to an aspect of the present invention, the pin is made of plastics. A pin friction surface of plastics may have a lower friction on the guide rail as a clip friction surface of steel.

According to an aspect of the present invention, the clamping part protrudes inclined from the attachment part. In particular, the foot of the guide rail may be tapered. The attachment part of the clip may be attached to a surface of the bracket besides the foot and the clamping part may lie on a surface of the tapered foot of the guide rail.

According to an aspect of the present invention, the attachment part comprises a hole for receiving a screw or bolt for attaching the clip to the support bracket. It also may be possible that the screw or bolt is provided by the clip, i.e. the attachment part.

A further aspect of the invention relates to an elevator guiding system, which comprises an elevator guide rail for guiding an elevator car inside an elevator shaft; at least one support bracket for supporting the elevator guide rail; and at least one clip as described in the above and in the following. Such an elevator guiding system may be especially suited for elevators in buildings with high building contraction, for example tall buildings, big elevators and/or seismic installations.

In the following, advantageous embodiments of the invention will be described with reference to the enclosed drawings. However, neither the drawings nor the description shall be interpreted as limiting the invention.

The figures are only schematic and not to scale. Same reference signs refer to same or similar features.

DETAILED DESCRIPTION

Figure 1:
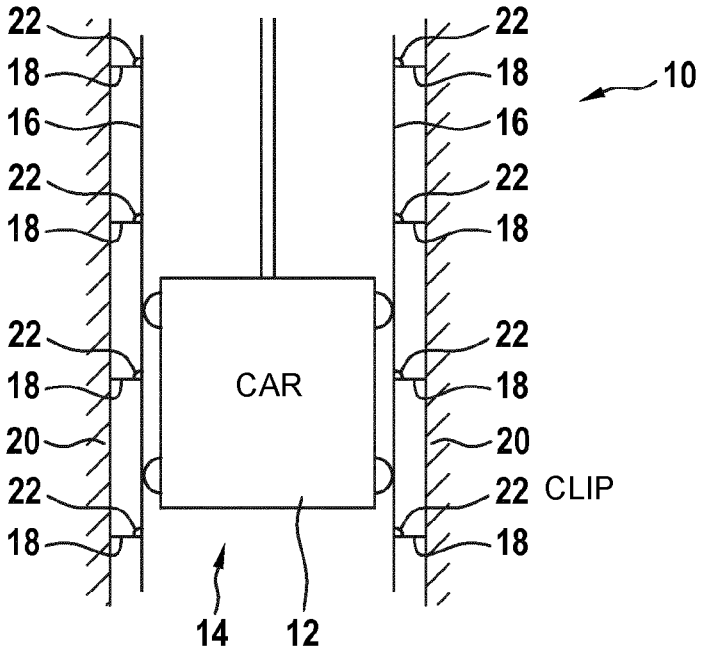
FIG. 1 shows an elevator with an elevator guiding system according to an embodiment of the invention.

FIG. 1 schematically shows an elevator guiding system 10 for guiding an elevator car 12 in an elevator shaft 14. The elevator car 12 is guided on vertical guide rails 16 that are attached via brackets 18 to walls 20 of the elevator shaft 14.

The guide rails 16 are attached via clips 22 to the brackets 18 in such a way, that they exhibit a different behavior in a normal loaded situation (i.e. remote the car 12) and a car loaded situation (i.e. near the car).

In the normal loaded situation (for example as for the upper two brackets 18), the clips 22 act as sliding clips, in which a guide rail 16 may move with respect to the respective bracket 18 in a vertical direction. When building contraction takes place, the guide rails 16 may move with respect to the brackets 18 and will not be deformed.

In the car loaded situation (for example for the brackets besides the car 12), the clips 22 act as fixed clips, in which a high friction is provided between the respective clip 22 and guide rail 16, such that high loads may be transferred between the guide rail 16 and the bracket 18.

Figure 2:
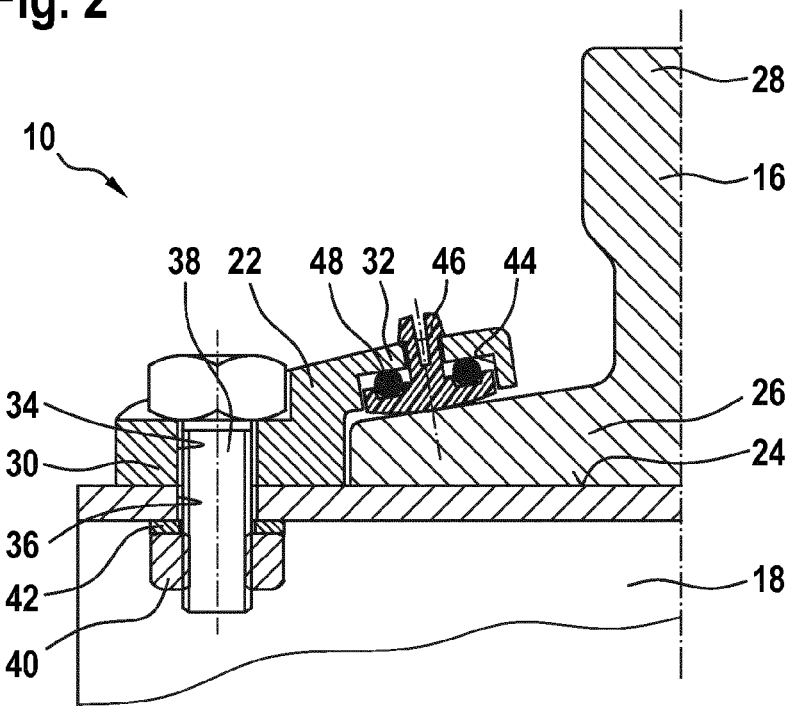
FIG. 2 shows a cross-sectional view of a part of the elevator guiding system with a clip according to an embodiment of the invention.

FIG. 2 shows a cross-section through a bracket 18 and a guide rail 16, which are attached to each other via a clip 22.

FIG. 2 just shows a part of the bracket, which is attached to one of the walls 20 of the elevator shaft 14. The bracket 18 provides a flat face 24 on which a foot 26 of the guide rail 16 is positioned. The guide rail 16 is clamped with its foot 26 with a clip 22 against the flat face of the bracket 18.

Also the guide rail 16 is T-shaped. It has to be noted that only one half of the guide rail 16 is shown in FIG. 2. The guide rail 16 may be symmetric with respect to a middle symmetry plane and/or also may be clamped to the bracket 18 on the opposite side with a further clip 22 in a symmetric manner. A head 28 of the guide rail 16 is provided for guiding the car 12, i.e. guiding rolls attached to the car may roll on the head 28.

The clip 22 has an attachment part 30 and a clamping part 32, which both may be one-piece and made from a material of high stiffness, such as forged steel.

The attachment part 30 comprises a through-hole 34, which is positioned opposite to a corresponding through-hole 36 in the bracket 18. A bolt 38 (for example a hex bolt) running through both through-holes 34, 36, which is screwed with a nut 40 (such as a hex nut) against the bracket, is used for attaching the clip 22 with the attachment part 30 to the bracket 18. A washer 42 may be positioned between the nut and the bracket 18.

As the foot 26 of the guide rail 16 is tapered, the clamping part 32 protrudes inclined from the attachment part 30. The clamping part 32 comprises a pin hole 44 on the side facing the foot 26 of the guide rail 16, in which pin hole 44 a pin 46 is received. Between the pin and the bottom of the pin hole 44, a spring element 48 in the form of an O-ring or rubber ring is positioned. It has to be understood that the spring element 48 also may be a disc spring or other resilient member.

Figure 3:
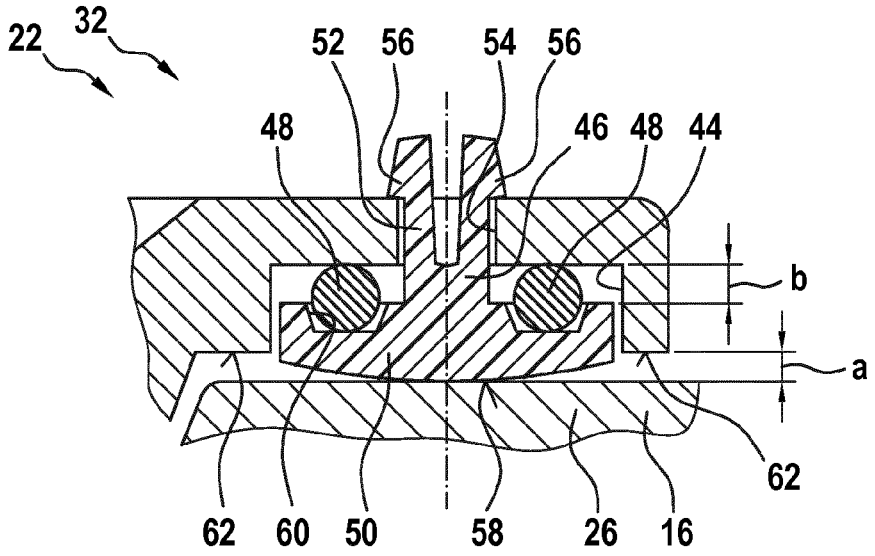
FIG. 3 shows a cross-sectional view of the clip of FIG. 1 in a protruding position.

FIG. 3 shows the clamping part 32 of the clip 22 in more detail. The pin 46, which may be made of plastics, comprises a pin head 50, which substantially has the same diameter as the pin hole 44 and a pin foot 52, which protrudes from the pin head 50 and/or which has a smaller diameter.

The pin foot 52 is guided through a further hole 54 provided in the clamping part 32 at the bottom of the pin hole 44. The further hole 54 has a smaller diameter than the pin hole 44 and/or has substantially the same diameter as the pin foot 52. At its end, the pin foot 52 comprises sideward protrusions 56 for preventing the pin 46 from falling out of the pin hole 44.

The pin head 50 comprises a pin friction surface 58 facing out of the pin hole 44 and/or a slot 60 surrounding the pin foot 52 on the opposite side. The slot 60 accommodates at least a part of the spring element 48. The pin friction surface 58 may be spherical.

FIG. 3 shows the clip 22 in a protruding position. The pin head 50 protrudes from the clamping part 32 and only the pin friction surface 58 is in contact with the guide rail 16. This is due to the fact that the clamping force between the clip 22 and the guide rail 16 is smaller than a resilient force provided by the spring element 48.

The distance a between the guide rail 16 and a clip friction surface 62 (which is not in contact with the guide rail 16 in this position) is smaller than a distance b between the backside of the pin head 50 and the bottom of the pin hole, since the spring element is not completely compressed. As an example, the distance a may be about or smaller than 3 mm.

In this position, the clip 22 may work as a sliding clip, for example while the elevator car 12 is stopped, remote from the clip 22 and/or in cases of low loads, allowing slippage between the guide rail 16 and the bracket 18.

The low friction between the clamping part 22 and the guide rail 16 may be caused by the material of the pin friction surface 58 (such as plastics) and/or the shape of the pin friction surface 58 (such as a spherical surface). The force applied to the guide rail 16 is provided by the spring element 48 (such as a rubber O-ring). As this force may be very low, the low friction coefficient between the pin friction surface 58 and the guide rail 16 will result in very low friction rates.

Figure 4:
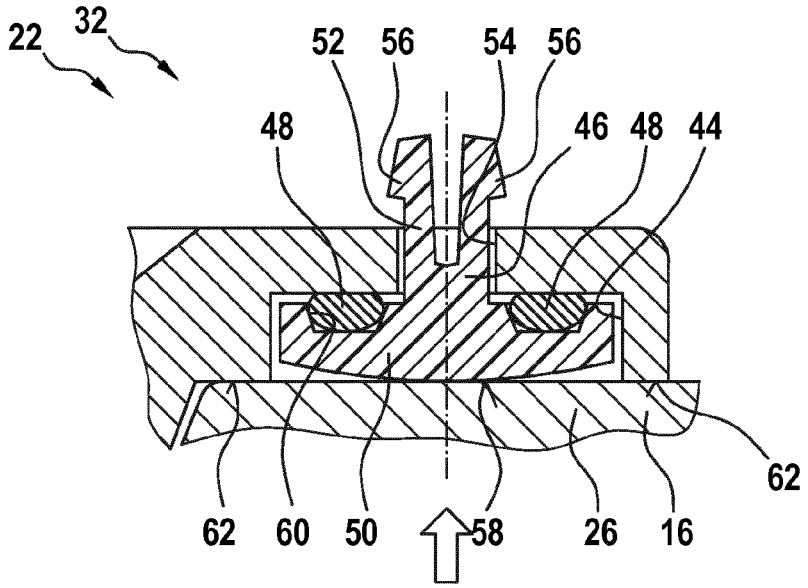
FIG. 4 shows a cross-sectional view of the clip of FIG. 1 in a pushed-in position.

FIG. 4 shows the clip 22 in a pushed-in position. The pin 46 has been moved completely into the pin hole 44 due to a higher force on its head 50 indicated by the arrow. This higher force may be caused by the car 12 moving by.

When the guide rail 16 touches the clip friction surface 62 (which surrounds the pin hole 44), all the additional load in the clip 22 begins to be supported by the clamping part 32 and the interconnected attachment part 30. A much higher friction force between the clip 22 and the guide rail 16 is provided and/or higher forces may be transferred between the guide rail 16 and the bracket 18.

As the pin 46 is hidden in the pin hole 44, the maximum force applied on the pin 46 is the force caused by the compressed spring element 48, avoiding a premature wear of the pin 46.

Once the additional load goes away, due to the spring element 48, the clip 22 automatically returns to the protruding position.

As shown in FIG. 4, the slot 60 in the pin 46 allows for a deformation of the rubber ring 48 in a sideward direction, so that the rubber ring 48 is not damaged in its maximal compressed position.

Finally, it should be noted that the term "comprising" does not exclude other elements or steps and the "a" or "an" does not exclude a plurality. Also elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A clip for attaching an elevator guide rail to a support bracket, the clip comprising:

an attachment part for attaching the clip to the support bracket;

a clamping part for clamping the guide rail against the support bracket;

a pin guided in the clamping part and movable between a pushed-in position and a protruding position;

a spring element arranged inside the clamping part and biasing the pin against movement from the protruding position into the pushed-in position; and wherein the clamping part includes a clip friction surface for touching the guide rail when the pin is in the pushed-in position, and the pin includes a pin friction surface for touching the guide rail when the pin is in the protruding position, the pin friction surface having a lower coefficient of friction than a coefficient of friction of the clip friction surface.

2. The clip according to claim 1 wherein the pin friction surface is one of convex and spherical.

3. The clip according to claim 1 wherein the clip friction surface is at least one of flat and surrounds the pin friction surface.

4. The clip according to claim 1 wherein the clamping part includes a pin hole formed therein for at least one of receiving the pin and guiding the pin.

5. The clip according to claim 4 wherein an axial distance between a backside of a head of the pin and a bottom of the pin hole is larger than a distance the pin friction surface protrudes from the clamping part.

6. The clip according to claim 1 wherein the pin includes a foot protruding through a hole formed in the clamping part.

7. The clip according to claim 6 wherein the pin has a head attached to the foot and wherein the head has a larger diameter than a diameter of the foot.

8. The clip according to claim 1 wherein the pin includes a foot having a sideward protrusion for preventing the pin from moving out of the clamping part when the pin is moved into the protruding position.

9. The clip according to claim 1 wherein the pin includes a head having the pin friction surface formed thereon.

10. The clip according to claim 1 wherein the pin has a slot formed therein, the slot being at least one of: receiving the spring element; provided in a backside of a head of the pin; and surrounding a foot of the pin.

11. The clip according to claim 1 wherein the spring element is a resilient ring accommodated between a head of the pin and the clamping part.

12. The clip according to claim 11 wherein the pin has a slot formed, the resilient ring is accommodated in the slot, the slot being wider than the resilient ring, such that the resilient ring is deformable in the slot in a lateral direction when the pin is pressed against the clamping part.

13. The clip according to claim 1 wherein at least one of the attachment part and the clamping part is made of steel.

14. The clip according to claim 1 wherein the pin is made of plastics.

15. The clip according to claim 1 wherein the clamping part protrudes inclined from the attachment part.

16. The clip according to claim 1 wherein the attachment part has a hole formed therein for receiving a screw or bolt for attaching the clip to the support bracket.

17. An elevator guiding system including at least one of the clip according to claim 1, the system comprising:

an elevator guide rail for guiding an elevator car inside an elevator shaft;

at least one support bracket for supporting the elevator guide rail; and the at least one clip attaching the elevator guide rail to the at least one support bracket.

* * * * *